United States Patent [19]

Ford

[11] Patent Number: 4,713,029

[45] Date of Patent: Dec. 15, 1987

[54] INVERTED FLOW MARINE ENGINE EXHAUST MUFFLER

[75] Inventor: John R. Ford, Xenia, Ohio

[73] Assignee: Vernay Laboratories, Inc., Yellow Springs, Ohio

[21] Appl. No.: 15,415

[22] Filed: Feb. 17, 1987

[51] Int. Cl.[4] ..... F01N 1/14; B63H 21/32

[52] U.S. Cl. ..... 440/89; 181/221; 181/238

[58] Field of Search ..... 440/89, 88; 181/260, 181/235, 221, 238, 240, 264; 60/272

[56] References Cited

U.S. PATENT DOCUMENTS

| | | | |
|---|---|---|---|
| 724,124 | 3/1903 | Perkins | 181/260 |
| 1,065,707 | 6/1913 | Montgomery | 181/235 |
| 1,074,627 | 10/1913 | Kenney | 181/260 |
| 1,076,571 | 10/1913 | Hall, Jr. | 181/260 |
| 1,759,679 | 5/1930 | Backman | 181/238 |
| 2,961,059 | 11/1960 | Blair | 181/56 |
| 3,291,252 | 12/1966 | Davis | 181/39 |
| 3,296,997 | 1/1967 | Hoiby et al. | 440/89 |
| 3,431,882 | 3/1969 | Irgens | 440/89 |
| 4,184,566 | 1/1980 | Baker et al. | 181/261 |

FOREIGN PATENT DOCUMENTS

| | | | |
|---|---|---|---|
| 23980 | 12/1914 | United Kingdom | 181/235 |
| 344735 | 3/1931 | United Kingdom | 440/89 |
| 1127807 | 12/1984 | U.S.S.R. | 440/89 |

*Primary Examiner*—Jeffrey V. Nase
*Assistant Examiner*—Edwin L. Swinehart
*Attorney, Agent, or Firm*—Biebel, French & Nauman

[57] ABSTRACT

An exhaust muffler for a marine engine comprises a first vertically oriented tubular member having a lower end sealingly extended through the bottom of a main body chamber and an upper end extending upwardly through the top of the chamber. A second tubular member surrounds and is spaced from the first tubular member for forming a passage therebetween, and has its upper end sealingly extended through the top of the chamber and its lower end extending to a point below two chamber inlets, yet spaced from the bottom of the chamber. A cap seals the upper end of the second tubular member to invert upwardly flowing exhaust gases and cooling fluid within the passage between the first and second tubular members downwardly into the first tubular member for discharge from the muffler.

7 Claims, 5 Drawing Figures

INVERTED FLOW MARINE ENGINE EXHAUST MUFFLER

BACKGROUND OF THE INVENTION

This invention relates generally to mufflers for carrying away the combination of exhaust gases and cooling fluid coming from a marine engine, and more particularly, to a compact, inverted flow marine muffler which provides improved attenuation of the exhaust noise generated by operation of marine engines.

Internal combustion engines utilized in watercraft standardly use the water supporting the craft for engine cooling purposes. The water is drawn into the craft and circulated through an engine cooling jacket or engine coolant heat exchanger. The water is then commonly ejected into the exhaust system to cool the combustion gases such that they might be safely discharged through the hull of the craft without presenting a fire hazard. Accordingly, a marine exhaust muffler must handle not only exhaust gases, but also the waste cooling fluid or water which is discharged from the craft through the exhaust system.

In addition to safely handling exhaust gases and waste coolant water, a marine muffler, as its name implies, should muffle or attenuate the exhaust noise generated by operation of the marine engine. Muffling of exhaust noise from marine engines has been handled in a number of ways. For example, the exhaust may be discharged below the water level. Such muffling is performed in outboard engines and inboard/outboard installations wherein the exhaust is routed through the drive unit such that the exhaust gases and waste cooling water are discharged through or adjacent the propeller driving the craft. In direct drive watercraft wherein no comparable drive unit is provided, it is not practical or convenient to run the exhaust along this route.

For direct drive applications, mufflers of various designs have been placed in the exhaust conduit running between the engine and the discharge. Often, these muffler designs are in-line closely akin to the mufflers utilized on automobiles, but constructed of materials, such as fiberglass, which can better tolerate the marine environment. While such mufflers are currently in high use in the boating industry, they do not provide good attenuation of the noise generated by marine engines. Loud exhaust noise can contribute to fatigue and diminish tne pleasure of boaters, for example, by interfering with audio entertainment and communications on board the craft.

Other more effective muffler designs are available. For example, a cannister or drum exhaust muffler system, is disclosed in U.S. Pat. No. 3,296,997, issued to Hoiby et al. on Jan. 10, 1967. This muffler is particularly applicable to engines which are mounted below the water line in large watercraft. Unfortunately, while this drum muffler design is more acoustically effective than the common in-line muffler, it has considerable bulk and provides an upward pumping action and discharge, which of course is the desired intent of the drum muffler.

There is thus a need for an improved compact muffler design for a marine engine which can safely handle the combination of exhaust gases and cooling fluid from a marine engine and also provide improved attenuation of the exhaust noise generated by operation of the marine engine.

SUMMARY OF THE INVENTION

In accordance with the present invention, a marine muffler provides improved attenuation of exhaust noise generated by operation of a marine engine by means of a compact muffler design which includes an inverted flow of the combination of exhaust gases and cooling fluid coming from the engine to facilitate exhausting such gases and cooling fluid from a watercraft through a single, conventionally oriented exhaust pipe.

According to one aspect of the present invention, an exhaust muffler for a marine engine comprises a main body chamber having inlet means for carrying a combination of exhaust gases and cooling fluid from a marine engine into the chamber. First tubular means are associated with the chamber by having a lower end sealingly extended through the bottom of the chamber and an upper end extending upwardly within the chamber in a generally vertical orientation. The combination of exhaust gases and cooling fluids are carried downwardly from the chamber through the first tubular means. Second tubular means surround and are spaced from the first tubular means for forming a passage therebetween. The second tubular means has its upper end substantially adjacent the upper end of the first tubular means and its lower end extending to a point below the inlet means, yet spaced from the bottom of the main body chamber. Cap means seal the upper end of the second tubular means for inverting the flow of exhaust gases and cooling fluid from the passage defined between the first and second tubular means into the first tubular means. In this way, as exhaust gases and cooling fluid are carried into the chamber, the cooling fluid accumulates on the bottom of the chamber and rises toward the lower end of the passage defined between the second tubular means and the first tubular means. As this fluid rises, a pressure differential is set up between the chamber and the exhaust path defined by the passage, the cap means and the first tubular means, such that the combustion gases carry portions of the cooling fluid upwardly to the top of the passage where they are diverted downwardly into the first tubular means by the cap means and discharged from the chamber through the first tubular means. This exhaust path for the combination of the exhaust gases and cooling fluid defines the inverted flow in accordance with the present invention.

Contrary to the popular in-line mufflers wherein a muffler is required for each exhaust outlet of a marine engine, an exhaust muffler in accordance with the present invention can accept two or more exhaust outlets from an engine. In accordance with this aspect of the present invention, the main body chamber is elongated and the inlet means comprise at least two tubular inlets at opposite ends of the chamber such that at least two exhaust outlets from a marine engine can be received therein.

To facilitate the inversion performed by the cap means, it preferably defines a central inwardly extending depression to smoothly invert the upward flow of exhaust gases and cooling fluid from the passage downwardly into the first tubular means. Manufacture of the muffler can be facilitated by extending the upper end of the second tubular means sealingly through the top of the chamber, with the cap means being positioned exterior of the chamber.

Preferably, the inlet means and the first and second tubular means are substantially circular in cross-section and the passage is annular in cross-section. The muffler main body chamber is preferably circular in cross-section also, and substantially larger in cross-section than either the inlet means or the second tubular means or outlet from the marine muffler.

It is, therefore, a primary object of the present invention to provide an improved muffler for a marine engine which provides good attenuation of engine exhaust noise generated by operation of the engine by means of an inverted flow of the exhaust gases and cooling fluid substantially within a muffler main body chamber which is sized and configured to facilitate installation in even small power boats.

Other objects and advantages of the invention will be apparent from the following description, the accompanying drawings and the appended claims.

DETAILED DESCRIPTION OF THE INVENTION

Figure 2:
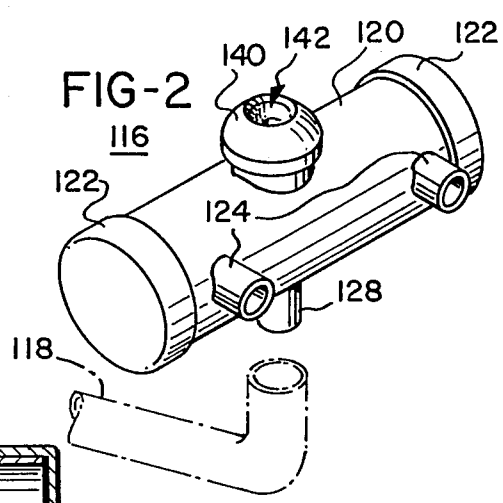
FIG. 2 is a perspective view of the muffler of FIG. 1.
Figure 1:
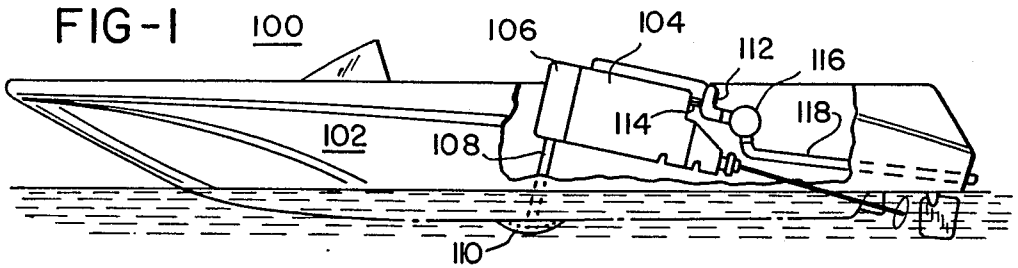
FIG. 1 is a schematic side view of a small power boat showing an inboard, direct drive marine engine incorporating an inverted flow marine muffler in accordance with the present invention.
Figure 3:
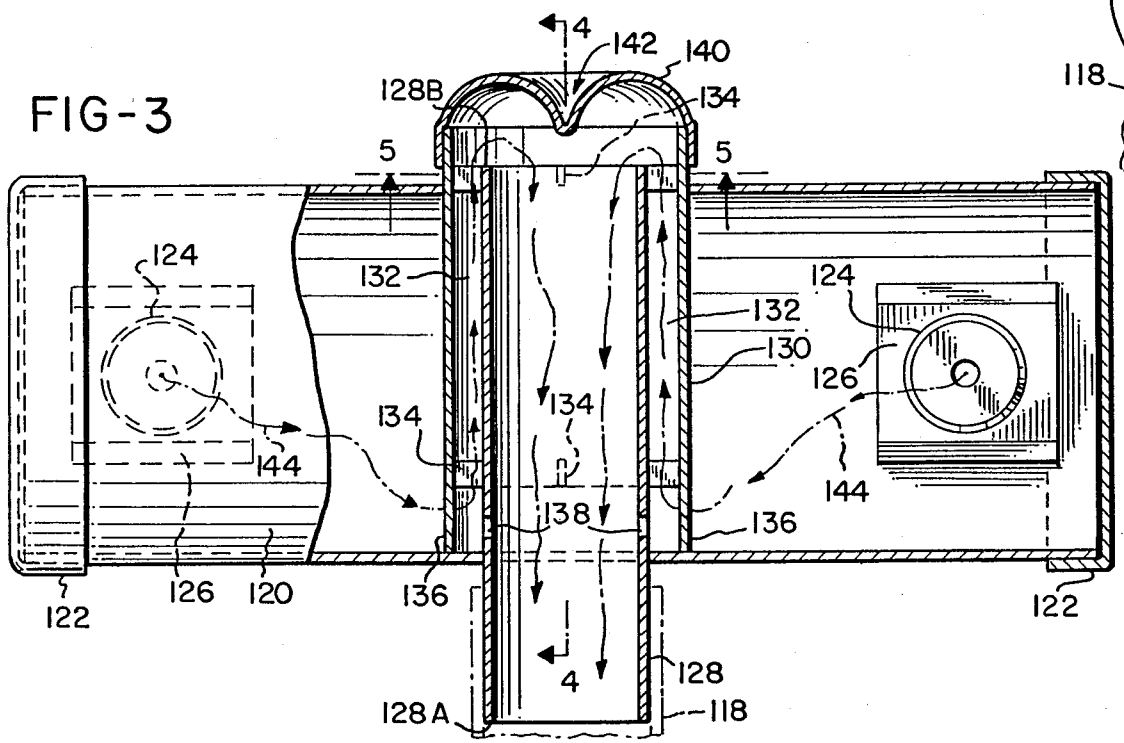
FIG. 3 is a side view of the muffler of FIG. 1.
Figure 4:
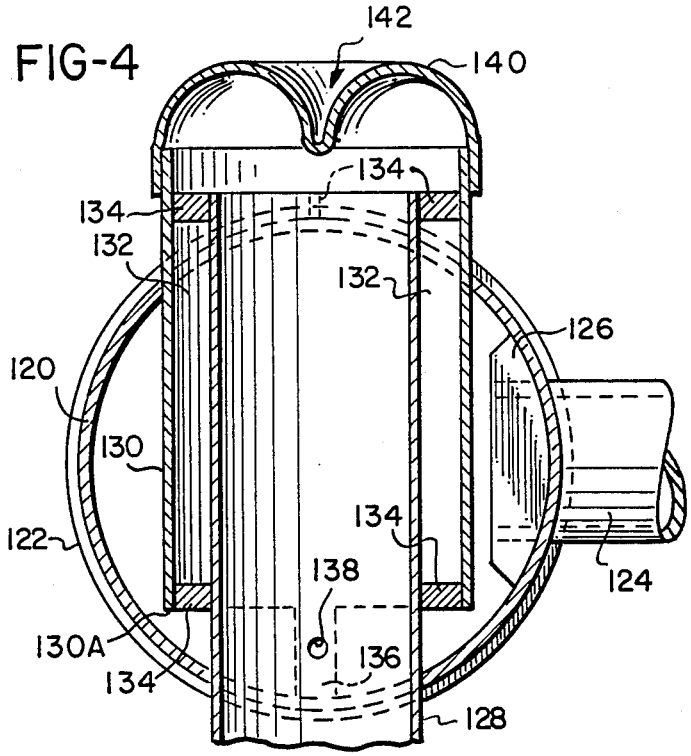
FIG. 4 is a sectional view through the marine muffler of FIG. 3 taken along the section line 4—4.
Figure 5:
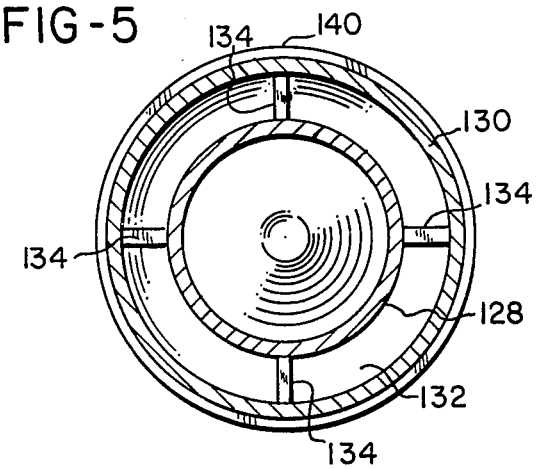
FIG. 5 is a sectional view of the marine muffler of FIG. 3 taken along the section line 5—5.

The invention will now be described with reference to the drawing figures wherein FIG. 1 schematically shows a watercraft 100 having a hull 102. The watercraft 100 is shown as a high powered ski boat having an inboard engine 104 which drives a water pump 106 to draw engine cooling water through a water inlet conduit 108 from beneath the hull 102. Water enters the water inlet conduit 108 through a relatively coarse strainer 110 which prevents large debris from entering the inlet conduit 108 and clogging the internal passages of the cooling system for the engine 104.

Water is pumped through the water inlet conduit 108 by the water pump 106, through a cooling jacket formed within the engine 104 and ultimately exits through the exhaust system by being injected into an exhaust manifold 112 through a small conduit 114. The exhaust manifold 112 in the illustrated embodiment comprises twin exhausts from a V-type engine or the like which are connected to inlet means for a muffler 116 in accordance with the present invention.

The combination of the exhaust gases and waste cooling water are discharged out the bottom of the muffler 116 and passed outside the watercraft 100 by means of an exhaust pipe 118. Although the exhaust pipe 118 is a single pipe, and typically there are two exhaust pipes from a dual exhaust marine engine, the exhaust pipe 118 is conventionally oriented in that it runs below the floorboard and discharges the exhaust gases and waste coolant water through the transom located at the stern of the boat.

FIGS. 2–5 show the illustrative embodiment of the marine muffler 116 in accordance with the present invention as comprising a main body chamber 120 which is closed except for inlet and outlet means, and is preferably circular in cross-section such that it comprises a closed-end cylinder. For ease of manufacture, the muffler main body chamber 120 is formed as an open-ended cylinder with end caps 122 serving to close and seal the ends thereof.

Inlet means comprising first and second circular inlet tubes 124 are inserted through the side wall of the main body chamber 120 where they are securely supported by support blocks 126. The inlet tubes 124 carry a combination of exhaust gases and cooling fluid or waste cooling water from the exhaust of a marine engine, such as the engine 104, into the main body chamber 120. More than two inlet tubes 124 could be used in the invention of the present application and such tubes could be inclined from the horizontal, extend through the end caps 122, enter the main body chamber from the top thereof or the like to accommodate various boat constructions.

First tubular means, preferably comprising a circular outlet tube 128 having a lower end 128A which is sealingly extended through the bottom of the main body chamber 120 and an upper end 128B extending upwardly within the main body chamber 120 in a generally vertical orientation. In the illustrated embodiment, and preferably, the outlet tube 128 extends through the top of the main body chamber 120 to facilitate assembly of the exhaust muffler 116 in accordance with the present invention as will become apparent. The first tubular means serves to carry a combination of exhaust gases and cooling fluid from the main body chamber 120 downwardly therethrough to discharge the exhaust gases and cooling fluid from the muffler 116.

Second tubular means comprising a generally circular tube 130 of larger diameter than the outlet tube 128 surrounds and is spaced from the outlet tube 128 for forming a passage 132 therebetween. The second tube 130 has its upper end substantially adjacent the upper end of the outlet tube 128 and its lower end extending to a point below the inlet tubes 124, yet spaced from the bottom of the main body chamber 120.

In the preferred illustrated embodiment, the second tube 130 sealingly extends through the top of the main body chamber 120 to facilitate manufacture of the muffler 116. The second tube 130 and the outlet tube 128 are spaced apart from one another by means of thin spacers 134 to maintain the spacing therebetween, yet not restrict the annular passage 132. The second tube 130 is also supported by the main body chamber 120 by means of support legs 136 which extend downwardly and engage the bottom of the main body chamber 120. A drain hole 138 is provided through the outlet tube 128 such that waste cooling water can drain from the muffler 116 once the engine is stopped.

Cap means comprising a circular cap 140 seal the upper end of the second tube 130 external to the main body chamber 120. It should be apparent that by extending the first and second tubular members 128 and 130 through the top of the main body chamber 120, construction of the muffler is facilitated due to the ease of sealing the cap 140 onto the second tube 130. The cap 140 serves to invert the flow of exhaust gases and cooling fluid upwardly flowing in the annular passage 132 between the first and second tubular members 128 and 130 downwardly into the first tubular member 128 to thereby discharge the exhaust gases and cooling fluid out of the muffler 116 through the first tubular member 128.

The cap 140 defines a central inwardly extending depression 142 to smooth the inversion of the upward flow of exhaust gases and cooling fluid or waste water within the passage 132 downwardly into the outlet tube 128. Preferably, the cross-section of the main body chamber 120 is substantially larger than the cross-section of either the inlet tubes 124 or the outlet tube 128 since the attenuation of exhaust noise generated by an engine is directly proportional to the ratio of the cross-sectional area of the main body member to the cross-sectional area of the inlets and outlets.

While the operation of the inverted flow marine muffler in accordance with the present invention should be apparent from the above description, its operation will now be summarized. Exhaust gases and cooling fluid or waste water from the exhaust of a marine engine enter the main body chamber 120 through the inlet tubes 124. As the waste cooling water accumulates on the bottom of the chamber 120 and rises toward the lower end 130A of the second tubular member 130, and hence, the passage 132 formed between the first and second tubular members 128 and 130, a pressure differential is set up between the main body chamber 120 and the exhaust path defined by the passage 132, the cap 140 and the outlet tube 128 such that the combustion gases carry portions of the cooling fluid upwardly to the top of the passage 132 where they are smoothly diverted downwardly into the outlet tube 128 by the cap 140 and discharged from the main body chamber 120 through the outlet tube 128. This general flow of exhaust gases and cooling fluid, including the defined inverting path, is illustrated schematically by the arrows 144 in FIG. 3.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An exhaust muffler for a marine engine comprising:

a muffler main body chamber;

inlet means for carrying a combination of exhaust gases and cooling fluid from the exhaust of a marine engine into said chamber;

first tubular means having a lower end sealingly extended through the bottom of said chamber and an upper end extending upwardly within said chamber in a generally vertical orientation for carrying a combination of exhaust gases and cooling fluid from said chamber downwardly through said first tubular means;

second tubular means surrounding and spaced from said first tubular means for forming a passage therebetween, said second tubular means having its upper end substantially adjacent the upper end of said first tubular means and its lower end extending to a point below said inlet means and spaced from the bottom of said chamber; and cap means sealing the upper end of said second tubular means for inverting the flow of exhaust gases and cooling fluid from said passage defined between said first and second tubular means into said first tubular means whereby as the cooling fluid accumulates on the bottom of said chamber and rises toward the lower end of said second tubular means, and hence, said passage, a pressure differential is set up between said chamber and the exhaust path defined by said passage, said cap means and said first tubular means such that the combustion gases carry portions of the cooling fluid upwardly to the top of the passage whereat they are diverted downwardly into said first tubular means by said cap means and discharged from said chamber through said first tubular means.

2. An exhaust muffler for a marine engine as claimed in claim 1 wherein said main body chamber is elongated and said inlet means, comprise at least two tubular inlets at opposite-ends of said chamber whereby said exhaust muffler can accept at least two exhaust outlets from a marine engine.

3. An exhaust muffler for a marine engine as claimed in claim 1 wherein said cap means defines a central, inwardly extending depression to smoothly invert the upward flow of exhaust gases and cooling fluid from said passage downwardly into said first tubular means.

4. An exhaust muffler for a marine engine as claimed in claim 1 wherein the upper end of said second tubular means sealingly extends through the top of said chamber and said cap means is positioned exteriorly of said chamber whereby manufacture of said muffler is facilitated.

5. An exhaust muffler for a marine engine as claimed in claim 1 wherein said inlet means and said first and second tubular means are substantially circular in cross-section and said passage is annular in cross-section.

6. An exhaust muffler for a marine engine as claimed in claim 1 wherein said muffler main body chamber is circular in cross-section.

7. An exhaust muffler for a marine engine as claimed in claim 1 wherein the cross-section of said muffler main body chamber is substantially larger than the cross-section of either said inlet means or said second tubular means.

* * * * *